US006110019A

United States Patent [19]

Ohmori

[11] Patent Number: 6,110,019

[45] Date of Patent: Aug. 29, 2000

[54] ELECTRODE GENERATING HYDRO-DYNAMIC PRESSURE IN COMBINATION WITH GRINDING WHEEL

[75] Inventor: Hitoshi Ohmori, Wako, Japan

[73] Assignee: The Institute of Physical and Chemical Research, Saitama, Japan

[21] Appl. No.: 09/203,487

[22] Filed: Dec. 2, 1998

[30] Foreign Application Priority Data

Dec. 2, 1997 [JP] Japan ..... 9-331803

[51] Int. Cl.[7] ..... B24B 7/00

[52] U.S. Cl. ..... 451/72; 451/56; 451/443

[58] Field of Search ..... 125/11.04, 11.18, 125/11.19, 11.22, 11.23; 451/56, 72, 443

[56] References Cited

U.S. PATENT DOCUMENTS

| | | | |
|---|---|---|---|
| 5,472,371 | 12/1995 | Yamakura et al. | 451/56 |
| 5,547,414 | 8/1996 | Ohmori | 451/21 |
| 5,833,520 | 11/1998 | Kanda et al. | 451/72 |

FOREIGN PATENT DOCUMENTS 0 920 958 A2 6/1999 European Pat. Off. .

*Primary Examiner*—Timothy V. Eley
*Attorney, Agent, or Firm*—Griffin & Szipl, P.C.

[57] ABSTRACT

There is disclosed an electrode 10 generating hydro-dynamic pressure for electrolytic dressing grinding. The electrode has a plurality of narrow portions 11 having constant gaps from a processed surface 1*a* of a grinding wheel 1, and a plurality of concave portions 12 each disposed between the narrow portions and having a gap wider than the narrow portion. A section of flow path (gap) formed between the grinding wheel 1 and the electrode 10 becomes concave/convex along a moving direction of the grinding wheel 1. When the liquid repeatedly flows through the concave/convex gap, dynamic and static pressures generated in the gap largely fluctuate. By the fluctuation, the adhesion of metal deposits to the narrow portions 11 is reduced, and the concave portions 12 form pockets, so that the electrolytic liquid can be stably supplied and the inclusion of air can be reduced.

4 Claims, 3 Drawing Sheets

Electrical Behavior of Electrolytic Dressing

ELID Grinding Surface Roughness of Tungsten Carbide

ELECTRODE GENERATING HYDRO-DYNAMIC PRESSURE IN COMBINATION WITH GRINDING WHEEL

BACKGROUND OF THE INVENTION

1. Technical Field of the Invention

The present invention relates to an electrode generating hydro-dynamic pressure which generates a dynamic pressure in a gap with a grinding wheel by rotation of the grinding wheel for electrolytic dressing grinding.

2. Description of the Related Art

With the recent progress in scientific technique, requirements for superfine processing have been rapidly heightened. As mirror surface grinding means for satisfying the requirements, the present applicant et al. have developed and published an electrolytic in-process dressing grinding method (ELID grinding method) (Riken Symposium "Latest Technique Trend of Mirror surface Grinding" held on Mar. 5, 1991).

In the ELID grinding method, as diagrammatically shown in FIG. 1, instead of an electrode in conventional electrolytic grinding, an electrically-conductive grinding wheel 1 is used, an electrode 2 is disposed opposite to the grinding wheel 1 with a gap therefrom, and an electrically-conductive liquid 3 is passed between the grinding wheel and the electrode to apply a voltage to between the grinding wheel 1 and the electrode 2. During electrolytic dressing of the grinding wheel, a workpiece is ground by the grinding wheel. Specifically, in the grinding method, the metal-bonded grinding wheel 1 is used as an anode, while the electrode 2 opposite to the surface of the grinding wheel with a gap therefrom is used as a cathode. By performing the electrolytic dressing of the grinding wheel simultaneously with grinding operation, the grinding performance can be maintained/stabilized. Additionally, in FIG. 1, numeral 4 denotes a workpiece (material to be ground), 5 denotes an ELID power source, 6 denotes a power supplier, and 7 denotes a nozzle of the electrically-conductive liquid.

In the ELID grinding method, even if abrasive grains are fine, the clogging of the grinding wheel does not occur through the electrolytic dressing of the abrasive grains. By making fine the abrasive grains, a remarkably superior processed surface like a mirror surface can be obtained by the grinding processing. Therefore, it is expected that the ELID grinding method be applied to various grinding processings as means which can maintain the ability of the grinding wheel in an operation ranging from a highly efficient grinding to a mirror surface grinding and which can form in a short time a highly precise surface unable to be formed in the prior art.

In the ELID grinding described above, on the surface of the cathode 2 opposed to the anode of the metal-bonded grinding wheel 1, a characteristic phenomenon is observed that metal components of a grinding wheel bonding material are deposited based on the principle of electric plating, contrary to the electrolytic erosion of the grinding wheel bonding material, i.e., anode reaction. In principle, since the deposits on the cathode surface have a composition close to that of a pure metal, electric conductivity is not lost. However, when the ELID grinding processing is performed for a long time, problems arise: (1) the gap between the cathode and the grinding wheel is filled with the deposits; (2) a sufficient amount of electrolytic liquid cannot be stably supplied; and further (3) air is drawn in the electrode gap to make unstable the electrolytic dressing of the grinding wheel. Therefore, ELID grinding effect cannot be maintained at the time of a continuous unmanned operation, and it has been recognized that the problems should be solved to realize complete automation.

SUMMARY OF THE INVENTION

The present invention have been developed to solve the problems. Specifically, an object of the present invention is to provide an electrolytic dressing grinding electrode in which (1) the generation of deposits deposited on a cathode surface can be reduced, (2) a sufficient amount of electrolytic liquid can be stably supplied, and (3) inclusion of air into an electrode gap can be reduced, so that an unmanned operation for ELID grinding can be stably performed for a long time.

To attain this and other objects, the present invention provides an electrode generating hydro-dynamic pressure for electrolytic dressing grinding which is disposed opposite to a surface to be processed of an electrically-conductive grinding wheel with a gap therefrom. An electrically-conductive liquid is passed between the electrode and the processed surface to apply a voltage therebetween, and a workpiece is ground while electrolytic dressing of the grinding wheel is performed. The electrode has a plurality of narrow portions arranged at intervals in a moving direction of the grinding wheel and having constant gaps from the processed surface of the grinding wheel, and a plurality of concave portions each disposed between the narrow portions and having a gap wider than the narrow portion.

In the structure of the present invention, the electrode disposed opposite to the processed surface of the electrically-conductive grinding wheel with a gap therefrom has a plurality of narrow portions having constant gaps from the processed surface of the grinding wheel and a plurality of concave portions disposed between the narrow portions and having gaps wider than the narrow portions. Therefore, the section of a flow path of the electrically-conductive liquid formed between the grinding wheel and the electrode becomes wider where the concave portions exist, and narrower where no concave portions exist, so that the gap becomes concave/convex along the moving direction of the grinding wheel.

Therefore, the grinding wheel rotates along the concave/convex electrode surface, and the electrically-conductive liquid (electrolytic liquid, fluid) with which the gap is filled is circulated as the grinding wheel rotates. When the liquid repeatedly flows through the concave/convex gap, a dynamic pressure generated therebetween largely fluctuates. Specifically, the gap between the grinding wheel and the electrode has an outer peripheral portion open to atmospheric air. Therefore, according to so-called Bernoulli's theorem, the dynamic pressure is increased while a static pressure is reduced in the narrow portion in which the gap is small and the flow rate is high (close to the rate of the grinding wheel). Contrarily, the dynamic pressure is reduced while the static pressure is increased in the concave portion in which the gap is large and the flow rate is low. Therefore, a pressure pushed from the electrode side is exerted on the narrow portion, while a pressure drawn toward the electrode side is exerted to the concave portion.

As a result, the flow rate, the dynamic pressure and the static pressure largely fluctuate along the moving direction of the grinding wheel in the flow path of the electrically-conductive liquid, i.e., the concave/convex gap, and the adhesion of metal deposits which move to the cathode surface can be reduced by the fluctuation. Specifically, since the flow rate is high and the static pressure is large in the narrow portion in which the electrode closely abuts on the grinding wheel, most of the metal components of the grinding wheel bonding material are forced to flow to the concave portion without reaching the electrode. Therefore, the adhesion of the metal deposits to the narrow portions important for ELID grinding processing is reduced. Additionally, since the gap of the concave portion is set sufficiently larger as compared with the narrow portion, the adhesion of the metal deposits to the concave portion produces no adverse influence.

The concave portion formed in the electrode forms a source for generating a pressure fluctuation. Moreover, since the concave portion forms a pocket to hold electrolytic liquid (electrically-conductive liquid) containing no air, the electrolytic liquid can be stably supplied to the narrow portion with a narrow gap adjacent to the concave portion from the concave portion. Additionally, by stably supplying the electrolytic liquid, the air drawn into the electrode gap can be reduced. Therefore, ELID grinding can be performed in an unmanned operation stably for a long time.

According to a preferable embodiment of the present invention, the concave portions are formed in such a manner that the gap changes along the moving direction of the grinding wheel. In the structure, the pressure fluctuation along the grinding wheel can be appropriately adjusted. Furthermore, the concave portion may be provided with a gradually changing portion in which the gap gradually changes along the moving direction of the grinding wheel and a rapidly changing portion in which the gap rapidly changes. In the structure, the pressure fluctuation can be set large in the rapidly changing portion, and small in the gradually changing portion.

According to another preferred embodiment, the concave portions comprises a plurality of holes formed along the moving direction of the grinding wheel. The holes may have circular, rectangular, triangular and other optional configurations, and have optional size or distribution. Thereby, the pressure fluctuation along the grinding wheel can be adjusted in a wide range.

Other objects and advantageous characteristics of the present invention will become apparent from the following description with reference to the accompanying drawings.

DESCRIPTION OF PREFERRED EMBODIMENTS

Figure 1:
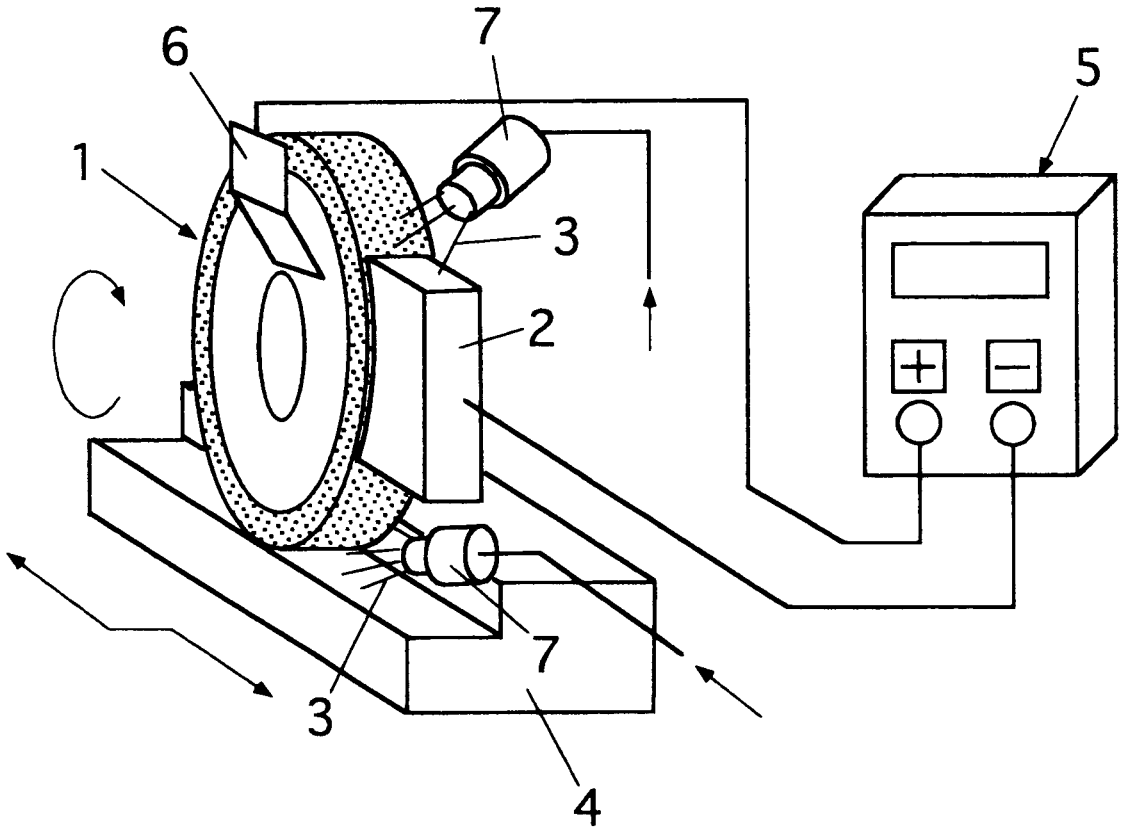
Fig. 1 (prior art)
FIG. 1 is a schematic diagram of ELID grinding device.

Hereinafter, preferred embodiments of the present invention will be described with reference to the drawings. Additionally, in the figures, common portions are denoted by the same reference characters, and duplicated description is omitted.

Figure 2A:
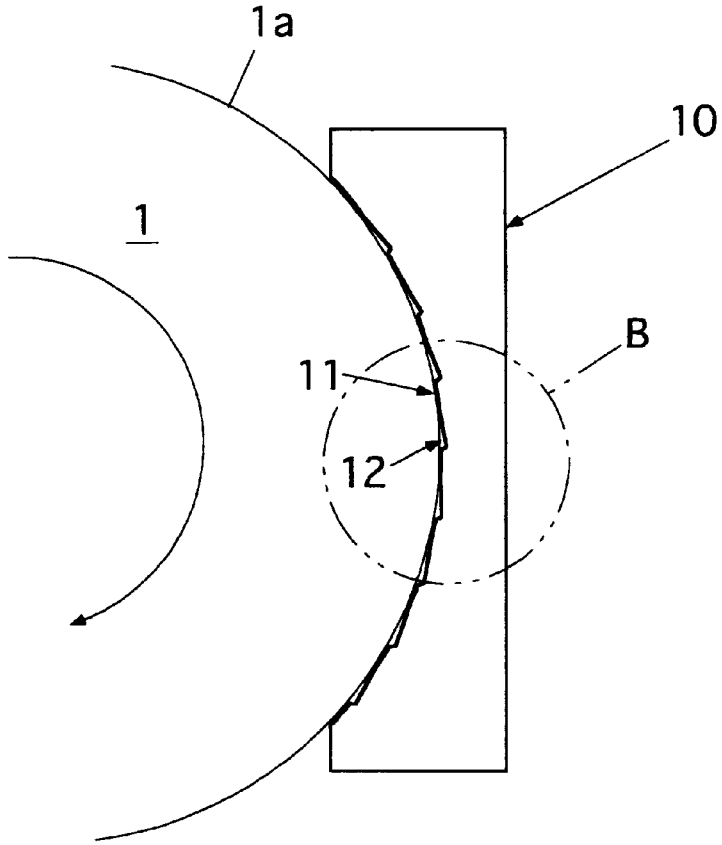
FIG. 2A is a side view of an electrode generating hydro-dynamic pressure of the present invention.
Figure 2B:
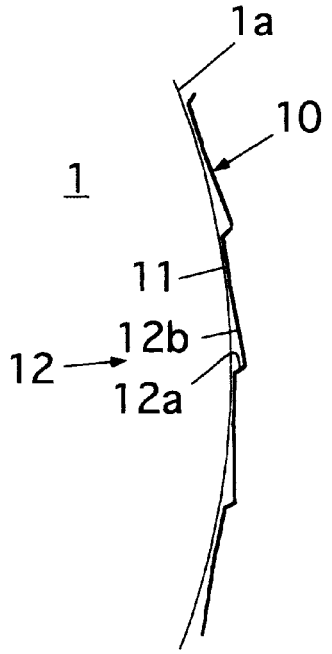
FIG. 2B is an enlarged view of a portion B.

FIG. 2A is a side view of an electrode generating hydro-dynamic pressure of the present invention, and FIG. 2B is an enlarged view of a portion B. Additionally, the electrode can be applied to the ELID grinding device shown in FIG. 1.

Specifically, such as electrode 2 shown in FIG. 1, an electrode generating hydro-dynamic pressure 10 of the present invention is an electrolytic dressing grinding electrode which is disposed opposite to a processed surface of the electrically-conductive grinding wheel 1 with a gap therefrom. While the electrically-conductive liquid 3 is passed between the electrode 10 and the processed surface, a voltage is applied by the ELID power source 5. While electrolytic dressing of the grinding wheel 1 is performed, the workpiece 4 is ground.

In FIG. 2A, the electrode 10 has a plurality of narrow portions 11 and a plurality of concave portions 12 each disposed between adjoining narrow portions on its surface opposite to the grinding wheel 1. The narrow portions 11 are arranged at intervals in the moving direction of the grinding wheel 1, and have constant gaps from a processed surface 1*a* of the grinding wheel 1. Additionally, the concave portion 12 has a gap from the processed surface 1*a* wider than the narrow portion 11. Specifically, in FIG. 2A, numeral 11 represents a portion other than the concave portion 12 on the surface of the electrode 10 opposite to the grinding wheel 1. The portion has a constant gap from the grinding wheel, and forms a narrowest portion between the electrode 10 and the grinding wheel 1.

In the structure described above, dirt on the electrode generated at the time of ELID grinding can be avoided, and water flow can simultaneously be secured. Specifically, according to the structure of the present invention, the electrode 10 disposed opposite to the processed surface 1*a* of the electrically-conductive grinding wheel 1 with a gap therebetween has a plurality of narrow portions 11 having a constant gap from the processed surface of the grinding wheel and a plurality of concave portions arranged between the narrow portions 11 and having a wider gap than the narrow portions 11. Therefore, the section of a flow path of the electrically-conductive liquid 3 formed between the grinding wheel 1 and the electrode 10 becomes wider where the concave portions 12 exist, and narrower where no concave portions 12 (narrow portions 11) exist, so that the gap becomes concave/convex along the moving direction of the grinding wheel 1.

Therefore, the grinding wheel 1 rotates along the concave/convex surface (inner surface in the example) of the electrode 10, and the electrically-conductive liquid 3 (electrolytic liquid, fluid) with which the gap is filled is circulated as the grinding wheel 1 rotates. When the liquid repeatedly flows through the concave/convex gap, a dynamic pressure generated therebetween largely fluctuates. Specifically, the gap between the grinding wheel 1 and the electrode 10 has an outer peripheral portion open to atmospheric air. Therefore, according to so-called Bernoulli's theorem, the dynamic pressure is increased while a static pressure is reduced in the narrow portion 11 in which the gap is small and the flow rate is high (close to the rate of the grinding wheel). Contrarily, the dynamic pressure is reduced while the static pressure is increased in the concave portion 12 in which the gap is large and the flow rate is low. Therefore, a pressure pushed from the side of electrode 10 is exerted on the narrow portion 11, while a pressure drawn toward the electrode side is exerted to the concave portion 12.

As a result, the flow rate, the dynamic pressure and the static pressure largely fluctuate along the moving direction of the grinding wheel 1 in the flow path of the electrically-conductive liquid 3, i.e., the concave/convex gap, and the fluctuation can reduce the adhesion of metal deposits which move to the cathode surface. Specifically, since the flow rate is high and the static pressure is large in the narrow portion 11 in which the electrode 10 closely abuts on the grinding wheel 1, most of the metal components of the grinding wheel bonding material are forced to flow to the concave portion 12 without reaching the electrode. Therefore, the adhesion of the metal deposits to the narrow portions 11 important for ELID grinding processing is reduced. Additionally, when the gap of the concave portion 12 is set sufficiently larger as compared with the narrow portion 11, the adhesion of the metal deposits to the concave portion produces no adverse influence.

The concave portion 12 formed in the electrode 10 forms a source for generating a pressure fluctuation. Moreover, since the concave portion forms a pocket to hold electrolytic liquid (electrically-conductive liquid) containing no air, the electrolytic liquid can be stably supplied to the narrow portion 11 with a narrow gap adjacent to the concave portion 12 from the concave portion 12. Additionally, by stably supplying the electrolytic liquid, the air drawn into the electrode gap can be reduced. Therefore, ELID grinding can be performed in an unmanned operation stably for a long time.

Moreover, as shown in FIG. 2B, in the embodiment, the concave portions 12 are formed in such a manner that the gap changes along the moving direction of the grinding wheel 1. Specifically, the concave portion may be provided with a gradually changing portion 12*b* in which the gap gradually changes along the moving direction of the grinding wheel 1 and a rapidly changing portion 12*a* in which the gap rapidly changes. Additionally, in the embodiment, the gradually changing portion 12*b* is formed on the upstream side, while the rapidly changing portion 12*a* is formed on the downstream side relative to the rotary direction of the grinding wheel 1, but the arrangement of the rapidly changing portion 12*a* and the gradually changing portion 12*b* may be reversed. In the structure, the pressure fluctuation is set large in the rapidly changing portion 12*a,* and small in the gradually changing portion 12*b,* so that the pressure fluctuation along the grinding wheel 1 can be appropriately adjusted.

Figure 2C:
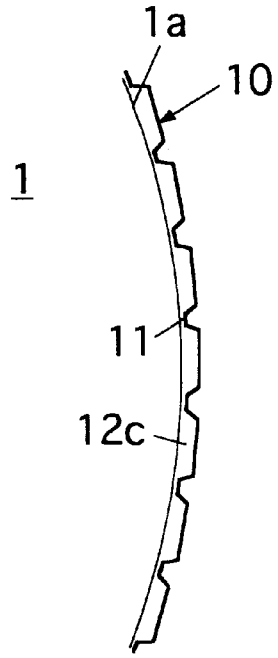

FIG. 2C is an enlarged view similar to FIG. 2B, showing another embodiment of the present invention. As shown in FIG. 2C, the concave portions 12 may comprise a plurality of holes 12*c* formed along the moving direction of the grinding wheel 1. The holes 12*c* may have, for example, circular, rectangular, triangular and other optional configurations. The holes may be extended in the width direction of the grinding wheel 1, or maybe distributed independently. Specifically, the holes 12*c* may have optional size or distribution. Thereby, the pressure fluctuation along the grinding wheel 1 can be adjusted in a wide range.

As aforementioned, in the ELID grinding device of the present invention, a special surface structure is formed in which a dynamic pressure is generated on the cathode surface by its relative movement to the metal-bonded grinding wheel and a plurality of electrolytic liquid pockets are produced. Thereby, cathode products in ELID grinding are reduced.

EXAMPLES

Examples of the present invention will next be described.

The electrode 10 generating hydro-dynamic pressure shown in FIG. 2A was prepared by way of trial and applied to electrolytic dressing grinding. The surface of the experimental electrode is provided with a multiplicity of stepped concave portions 12 each having the rapidly changing portion 12*a* and the gradually changing portion 12*b,* and a dynamic pressure can be generated in the electrolytic liquid 3 by rotation of the grinding wheel. Additionally, the experimental electrode is designed in accordance with a grinding wheel diameter of 150 mm, the opposed area has a size of about ¼ of a grinding wheel peripheral length, and each groove has a maximum depth of about 1 mm.

A device and system for use in an experiment are as follows:

(1) Grinding Device

A reciprocating type surface grinding machine was used, and ELID electrode, a power supplier were mounted on the machine for use in the experiment.

(2) Grinding Wheel

A cast-iron metal bond diamond grinding wheel (dia. 150 mm×width 10 mm, straight type) was used. For grain sizes, #325 was used for rough grinding, while #4000 was used for finish grinding. In either grinding concentration degree was 100.

(3) ELID Power Source

For ELID grinding an exclusive high-frequency pulse (DC-direct current) power source was used.

(4) Others

For the electrolytic liquid, standard water-soluble electrolytic liquid was diluted 50 times by distilled water and used.

(Experiment Method)

After truing of each grinding wheel by a rotary truer using a #80 GC grinding wheel, rough grinding of a tungsten carbide was first performed with #325. Subsequently, a #4000 grinding wheel was used to examine electrolytic dressing characteristics of the electrode generating hydro-dynamic pressure, and ELID mirror surface grinding effect of the tungsten carbide were confirmed. Processing results were evaluated mainly by surface roughness (roughness measuring apparatus).

(Experiment Results)

(1) Electrical Behavior of Initial Electrolytic Dressing

Figure 3:
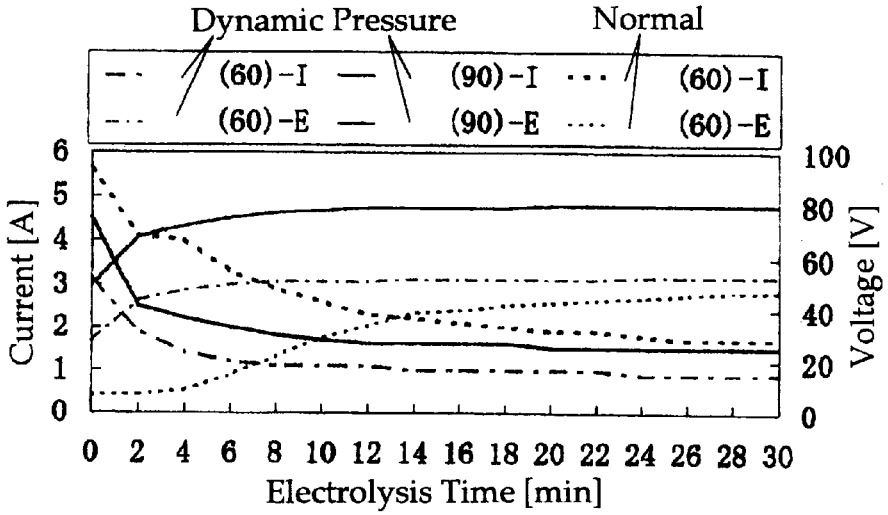
FIG. 3 is a diagram showing an electrical behavior of an electrolytic dressing using the electrode generating hydro-dynamic pressure of the present invention.

First, checking results of the electrical behavior of the initial electrolytic dressing by the electrode generating hydro-dynamic pressure are shown in FIG. 3. As compared with the usual electrode operation, a current value tends to be slightly large, while a voltage value tends to be reduced.

(2) Insulating Layer by Electrolytic Dressing

Figure 4:
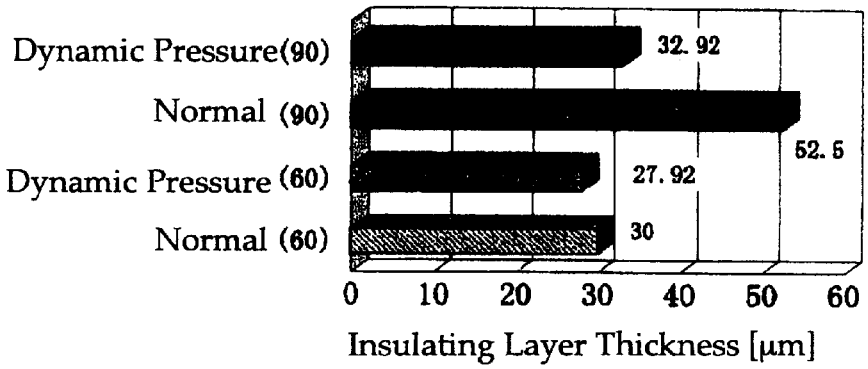
FIG. 4 shows measurement results of a insulating layer thickness by the electrode generating hydro-dynamic pressure of the present invention.

FIG. 4 shows checking results of the thickness of a insulating layer formed on the grinding wheel surface subjected to the initial electrolytic dressing by the electrode generating hydro-dynamic pressure. As a result, the thickness of the layer was smaller than that of a usual electrode, and became nearly ½ when 90V was applied. Since the average gap becomes larger than usual, the layer supposedly becomes thinner.

(3) ELID Mirror Surface Grinding Effect

Figure 5:
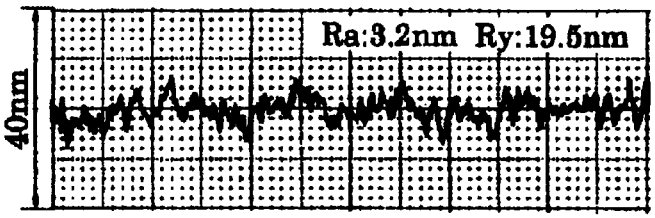
FIG. 5 is a graph of a measurement example of a surface roughness of a tungsten carbide by electrolytic dressing grinding using the electrode generating hydro-dynamic pressure of the present invention.

Furthermore, the roughly ground tungsten carbide was subjected to ELID grinding using the #4000 grinding wheel to which the initial dressing was applied by the electrode generating hydro-dynamic pressure. Results are shown in FIG. 5. As seen from FIG. 5, although a maximum 1 mm gap exists, a mirror surface state of a quality equal to or higher than the quality obtained through ELID mirror surface grinding by the usual electrode can be realized.

(4) Comparison of Cathode Products

In the usual electrode, depending on the material to be processed, metal deposits on the electrode are accumulated 100 to 150 microns or more in about eight hours. In this case, usually the first set electrode gap of 100 microns is almost filled.

On the other hand, when the electrode surface is provided with stepped concave/convex portions as in the present invention, there is a slight dispersion in data measurement, but the amount of metal deposits is suppressed to about 20 to 30 microns. However, a sufficient thickness of electrolytic insulating layer was formed on the grinding wheel surface, a sufficient ELID mirror surface grinding effect was confirmed, and remarkably effective results were obtained.

Specifically, as a result of examination of the electrode generating hydro-dynamic pressure surface after ELID mirror surface grinding was performed, it was seen that the amount of metal deposits was remarkably reduced as compared with the conventional electrode. Moreover, the effect of pockets on the electrode surface was used to realize ELID mirror surface grinding, and the effect of ELID mirror surface grinding by the electrode generating hydro-dynamic pressure could be confirmed.

Additionally, the electrode generating hydro-dynamic pressure of the present invention is not limited to the electrolytic dressing grinding electrode shown in FIG. 1, and can be applied to any electrode for electrolytic dressing grinding.

As aforementioned, the electrode generating hydro-dynamic pressure of the present invention can (1) reduce the generation of deposits deposited on the cathode surface, (2) stably supply a sufficient amount of electrolytic liquid, and (3) reduce the inclusion of air into the electrode gap. Thereby, ELID grinding can advantageously be performed in an unmanned operation stably for a long time, and other superior effects can be provided.

Additionally, although the present invention has been described by some preferred embodiments, it will be understood that the scope of rights included in the present invention is not limited to the embodiments. On the contrary, the scope of rights of the present invention includes all of improvements, modifications, and equivalents included in the scope of the appended claims.

What is claimed is:

1. An electrically-conductive grinding wheel in combination with an electrode generating hydro-dynamic pressure for electrolytic dressing grinding which is disposed opposite to a processed surface of said electrically-conductive grinding wheel with a gap therefrom for grinding a workpiece by passing an electrically-conductive liquid between the electrode and a peripheral surface of the grinding wheel to apply a voltage while electrolytic dressing of the grinding wheel is performed, said electrode comprising:

a plurality of narrow portions arranged at intervals in a direction of intended rotation of the grinding wheel and having constant gaps from the peripheral surface of the grinding wheel, and a plurality of concave portions each disposed between two narrow portions and having a gap wider than that of each of the narrow portions.

2. The electrode generating hydro-dynamic pressure according to claim 1 wherein said concave portions are formed in such a manner that the gap changes along the direction of intended rotation the grinding wheel.

3. The electrode generating hydro-dynamic pressure according to claim 1 wherein said concave portion comprises a gradually changing potion in which the gap gradually changes along the direction of intended rotation the grinding wheel and a rapidly changing portion in which the gap rapidly changes.

4. The electrode generating hydro-dynamic pressure according to claim 1 wherein said concave portions comprise a plurality of holes formed along the direction of intended rotation the grinding wheel.

* * * * *